United States Patent [19]

Wu et al.

[11] Patent Number: 5,068,476

[45] **Date of Patent: * Nov. 26, 1991**

[54] LUBRICANT OLIGOMERS OF $C_2$–$C_5$ OLEFINS

[75] Inventors: Margaret M. Wu, Belle Mead; Suzzy C. Ho, Plainsboro, both of N.J.

[73] Assignee: Mobil Oil Corporation, Fairfax, Va.

[ * ] Notice: The portion of the term of this patent subsequent to Feb. 5, 2008 has been disclaimed.

[21] Appl. No.: 647,102

[22] Filed: Jan. 29, 1991

Related U.S. Application Data

[63] Continuation-in-part of Ser. No. 345,061, Apr. 28, 1989, Pat. No. 4,990,709.

[51] Int. Cl.[5] ..... C10L 1/16

[52] U.S. Cl. ..... 585/12; 585/10; 585/11; 585/17; 585/19; 585/411; 585/452

[58] Field of Search ..... 585/11, 19, 411, 452, 585/10, 17, 12

[56] References Cited

U.S. PATENT DOCUMENTS

| | | | |
|---|---|---|---|
| 3,232,913 | 2/1966 | Van Weynbergh | 260/80.7 |
| 4,504,592 | 3/1985 | Van der Leemput | 502/104 |
| 4,681,866 | 7/1987 | McDaniel | 502/104 |
| 4,827,064 | 5/1989 | Wu | 585/10 |
| 4,827,073 | 5/1989 | Wu | 585/530 |

FOREIGN PATENT DOCUMENTS

| | | |
|---|---|---|
| 3427319 | 4/1984 | Fed. Rep. of Germany . |
| 63-57615 | 7/1988 | Japan . |

OTHER PUBLICATIONS

"Surface Compounds of Transistion Metals," Weiss, Journal of Catalysis 88, 424–430.

*Primary Examiner*—Patrick P. Garvin
*Assistant Examiner*—E. D. Irzinski
*Attorney, Agent, or Firm*—Alexander J. McKillop; Charles J. Speciale; Robert B. Furr, Jr.

[57] ABSTRACT

Liquid olefin oligomers are produced by the oligomerization of $C_2$–$C_5$ alpha olefin alone or with ethylene as a co-monomer. The oligomers having high viscosity index and a structure which is characterized by a regio-irregularity of at least 20 percent, usually from 20 to 40 percent. The olefins are oligomerized with a reduced valence state chromium oxide catalyst on a silica support, usually at a temperature from 90° to 250° C., although lower temperatures can also be used with ethylene as a con-monomer. The liquid oligomerization products can be produced in wide range of viscosities including the direct production of low viscosity lubricants having high viscosity index.

20 Claims, No Drawings

LUBRICANT OLIGOMERS OF $C_2$–$C_5$ OLEFINS

CROSS REFERENCE TO RELATED APPLICATIONS

This application is a continuation-in-part of prior application Ser. No. 07/345,061, filed Apr. 28, 1989 by M. M. Wu, now U.S. Pat. No. 4,990,709.

FIELD OF THE INVENTION

This invention relates to a olefin oligomers produced by a process of oligomerization using a $C_2$–$C_5$ alpha-olefin feed. The oligomer products, which may be either homo-oligomers of $C_3$–$C_5$ olefins or co-oligomers of $C_3$–$C_5$ olefins with ethylene, are useful as lubricants and lubricant additives e.g. viscosity index improvers, of superior quality which exhibit high viscosity index.

BACKGROUND OF THE INVENTION

Efforts to improve the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin (PAO) synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over an extended range of temperature, i.e.,improved viscosity index, while also showing good lubricity, thermal and oxidative stability and pour point equal to or better than mineral oils. These new synthetic lubricants may exhibit lower friction and hence increase the mechanical efficiency of the equipment in which they are used, for example, mechanical loads such as worm gears, gear sets, and traction drives as well as in engines and they may do so over a wider range of operating conditions than mineral oil lubricants.

Notwithstanding their generally superior properties, PAO lubricants are often formulated with additives to enhance those properties for specific applications. The more commonly used additives include oxidation inhibitors, rust inhibitors, metal passivators, antiwear agents, extreme pressure additives, pour point depressants, detergent-dispersants, viscosity index (VI) improvers, foam inhibitors and the like, as described, for example, in Kirk-Othmer "Encyclopedia of Chemical Technology", 3rd edition, Vol. 14, pp. 477–526, to which reference is made for a description of such additives and their use. Significant improvements in lubricant technology have come from improvements in additives.

Recently, high VI lubricant compositions comprising high viscosity index polyalpha-olefins (referred to here as HVI-PAO) have been disclosed in U.S. Pat. Nos. 4,827,064 and 4,827,073. The process for making these materials comprises, briefly, oligomerizin a $C_6$–$C_{20}$ 1-alkene feedstock such as 1-decene with a reduced valence state Group VIB metal catalyst, preferably a reduced chromium oxide on a porous silica support, to produce high viscosity, high VI, liquid hydrocarbon oligomers which have a characteristic structure with a branch ratio less than 0.19. The process is distinctive in that little isomerization of the olefinic bond occurs compared to known oligomerization methods to produce polyalpha-olefins using Lewis acid catalyst. A similar process using coordination catalysts to prepare high polymers from 1-alkenes, especially chromium catalyst on a silica support, is described by Weiss et al. in J. Catalysis 88, 424–430 (1984) and in DE-OS 3,427,319 and this process and its products are discussed in more detail below.

The high VI oligomers are characterized by good flow properties, usually having a pour point below −15° C. Lubricants produced by the process cover the full range of viscosities from low viscosity lubricants such as 5cS fluids to higher viscosity lubricant additives useful as VI improvers, for instance, oligomers having a viscosity of 1,000 cS or more, as described in Application Ser. No. 07/345,606, now U.S. Pat. No. 5,012,020 to which reference is made for a description of these high viscosity materials and their preparation. These high viscosity oligomers, too, exhibit a remarkably high VI and low pour point even at high viscosity. The as-synthesized HVI-PAO oligomer has olefinic unsaturation associated with the last of the recurring monomer units in the structure and accordingly, the oligomer will usually be subjected to a final hydrogenation treatment in order to reduce residual unsaturation to make a final, fully stable product.

Considering the abundance of $C_2$ to $C_5$ alpha-olefins in the petroleum refinery, and their low cost, it has long been recognized that they could be a preferred source of low cost lubricant if they could be oligomerized to provide high viscosity index lubricant in good yield with a manageable, regenerable, non-corrosive catalyst. Prior application Ser. No. 07/345,061 now U.S. Pat. No. 4,990,709 discloses a process for making oligomers of $C_3$–$C_5$ olefins using the reduced metal oxide catalysts. The olefin oligomers produced by the process are characterized by a unique structure which confers particularly useful properties on the products. In conventional Ziegler oligomerization of alpha olefins the oligomers produced contain a high degree of structural regularity, or regio-regularity, as exhibited by a preponderance of head-to-tail bonding in the oligomerization of these alpha olefins. In the products from Ziegler catalyzed oligomerization not more than twenty percent of the repeating units are linked by regular head-to-head and tail-to-tail bonding. In the olefin oligomers produced from the reduced metal oxide catalysts, however, at least twenty percent of the repeating units are bonded by irregular or head-to-head or tail-to-tail connections. These $C_3$–$C_5$ alpha-olefin oligomers therefore have a regio-irregularity of at least twenty percent, usually from 20 to 40 percent, and in most cases, not more than 60 percent (where 100% regio-regularity corresponds with all head-to-tail connections for the recurring oligomeric units). Thus, in most cases, from 60 to 80 percent of the recurring connections in the oligomer are linked by regular head-to-tail bonding.

SUMMARY OF THE INVENTION

According to the present invention, olefin oligomers produced from $C_3$–$C_5$ olefins, either alone or with co-oligomerized ethylene units, have a regio-irregularity of at least 20, and usually from 20 to 40 percent.

The oligomers can be produced by the process described in Ser. No. 07/345,061, now U.S. Pat. No. 4,990,709, that is, by contacting $C_3$–$C_5$ alpha-olefins or a mixture of $C_2$ to $C_5$ alpha-olefins with a reduced metal oxide catalyst, preferably a reduced chromium oxide on a solid, porous support. The catalyst is usually produced by oxidation at a temperature of 200° C. to 900° C. in the presence of an oxidizing gas and then by treatment with a reducing agent at a temperature and for a time sufficient to reduce the oxide of the metal to a lower valence state. Reference is made to Ser. No. 07/345,061 now U.S. Pat. No. 4,990,709 for a description of the process.

The olefin oligomers are characteristically liquids having a viscosity measured at 100° C. of 20 to 10,000 cS and useful as lubricant basestock or used as VI improvers. The oligomers may be hydrogenated to produce a saturated hydrocarbon product.

Propylene, 1-butene or 1-pentene can, either alone or with the addition ethylene as a co-monomer, be oligomerized and the olefin oligomers are separated by distillation to recover a gasoline boiling range overhead fraction, a distillate boiling range overhead fraction, and a lube boiling range bottoms fraction.

The oligomerization process provides excellent yields of a saturated hydrocarbon lubricant fraction from the oligomerization of $C_3$–$C_5$ alpha-olefins or a mixture of $C_2$ to $C_5$ alpha-olefins. The oligomerization of ethene, propylene or 1-butene or 1-pentene to produce the lubricant fraction results in a product particularly distinguished by a high viscosity index representative of superior lubricant properties. The lighter oligomer or hydrocarbon fraction separated from the oligomerization mixture is useful as gasoline or distillate product.

The oligomer products containing unsaturated double bonds are suitable as chemical intermediates for further functionalization, e.g., reaction with maleic anhydride to form adducts which can be used as intermediates for the production of lubricant additives.

DETAILED DESCRIPTION

In the following description, unless otherwise stated, all references to properties of oligomers or lubricants of the present invention refer to hydrogenated oligomers and lubricants when hydrogenation of the oligomer product is carried out, as will usually be preferred in order to reduce residual unsaturation.

The $C_3$–$C_5$ alpha olefin oligomers and the oligomers of $C_3$–$C_5$ alpha-olefins with ethylene are unique in their structure compared with conventional polyalphaolefins (PAO) from 1-decene, for example. Polymerization with the reduced metal, e.g. chromium catalyst leads to an oligomer substantially free of double bond isomerization. Conventional PAO, on the other hand, formed with a Friedel-Crafts catalyst such as $BF_3$ or $ALCl_3$ forms a carbonium ion which, in turn, promotes isomerization of the olefinic bond and the formation of multiple isomers. The HVI-PAO materials of the present invention have a structure with a $CH_3/CH_2$ ratio of less than 0.19 compared to a ratio of greater than 0.20 for conventional PAO.

The $C_2$–$C_5$ feedstocks used in the present invention are particularly inexpensive and common materials found in the petroleum refinery complex. Readily available sources include fluid catalytic cracker operation; in particular, the product of FCC unsaturated gas plant. The olefins are also available from the various steam cracking processes, e.g., light naphtha or LPG.

The mixtures of propylene, 1-butene or 1-pentene and ethylene can be used in a molar ratio from 100:1 to 0.1:1 ($C_3$–$C_5$:$C_2$), with a preferred molar ratio from about 10:1 to 0.2:1, in most cases from 5:1 to 0.3:1, for example, about 0.67:1 ($C_3$–$C_5$:$C_2$).

In the oligomerization of propylene, 1-butene or 1-pentene, the alpha-olefin can be used either in pure form or diluted with ethylene or other inert materials for production of the oligomers. The liquid products, after hydrogenation to remove unsaturation have higher viscosity indices than similar alpha-olefins oligomerized by conventional acid catalysts such as aluminum chloride or boron trifluoride.

To produce the low molecular weight liquid products suitable for use as lube basestock or as blending stock with other lube stock, the oligomerization is carried out at a temperature higher (90°–250° C.) than the temperature suitable to produce higher molecular weight polyalpha-olefins. In order to produce high molecular weightpolymers for use as VI improvers, low reaction temperatures, e.g. 0° to 90° C., are appropriate. Similar temperature ranges are also used to produce copolymers with ethylene and $C_3$–$C_5$ alpha-olefins.

OLIGOMERIZATION CATALYSTS

The oligomers are prepared by oligomerization reactions in which a major proportion of the double bonds of the alpha-olefins are not isomerized. These reactions include alpha-olefin oligomerization by supported metal oxide catalysts, such as Cr compounds on silica or other reduced Group VIB (IUPAC Periodic Table) metal compounds on porous supports. Preferred supports include silica, alumina, titania, silica alumina, magnesia and the like. The support material binds the metal oxide catalyst. Those porous substrates having a pore opening of at least 40 Ångstroms are preferred.

The support material usually has high surface area and large pore volumes with average pore size of 40 to about 350 Ångstroms. The high surface area are beneficial for supporting large amount of highly dispersive, active chromium metal centers and to give maximum efficiency of metal usage, resulting in very high activity catalyst. The support should have large average pore openings of at least 40 Ångstroms, with an average pore opening of at least 60 to 300 Ångstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a porous support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by a reducing agent such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds.

Alternatively, the Group VIB metal may be applied to the substrate in reduced form, such as Cr(II) compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor, a continuous stirred tank reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent, such as CO, is contacted therewith. When enough CO has passed through to reduce the catalyst there is a distinct color change from bright orange to pale blue. Typically, the catalyst is treated with an amount of CO equivalent to a two-fold stoichiometric excess to reduce the catalyst to a lower valence Cr(II) state. Finally the catalyst is cooled down to room temperature and is ready for use.

The use of supported Cr metal oxide in different oxidation states for polymerizing alpha olefins from $C_3$ to $C_{20}$ (DE 3427319, Journal of Catalysis 88, 424–430, (1984), above) using a catalyst prepared by $CrO_3$ on silica. These references disclose that polymerization takes place at low temperature, usually less than 100° C., to give adhesive polymers and that at high temperature, the catalyst promotes isomerization, cracking and hydrogen transfer reactions. The process used for making the present oligomers, however, produces liquid, low molecular weight oligomeric products using reaction conditions and catalysts which minimize side reactions such as 1-olefin isomerization, cracking, hydrogen transfer and aromatization. The reduced metal oxide catalysts do not cause a significant amount of side reactions even at the higher temperatures at which oligomeric, low molecular weight fluids are produced. These catalysts therefore minimize side reactions but oligomerize olefins to give low molecular weight polymers with high efficiency. Although the exact nature of the supported Cr oxide is difficult to determine, it is thought that the catalyst of the present invention is rich in Cr(II) supported on silica, which is more active to catalyze alpha-olefin oligomerization at high reaction temperature without causing significant amounts of isomerization, cracking or hydrogenation reactions. However, the catalysts described the cited references can be richer in Cr (III) and they catalyze alpha-olefin polymerization at low reaction temperature to produce high molecular weight polymers and at higher temperatures undesirable isomerization, cracking and hydrogenation reaction takes place.

Low catalyst concentrations based on feed, from 10 wt % to 0.01 wt %, are used to produce the present desired oligomers whereas, in the cited references, catalyst ratios based on feed of 1:1 are used to prepare higher polymers of higher molecular weight and viscosity. In addition, the catalysts described in the references cannot be used to polymerize ethylene or to produce copolymers of ethylene with alpha-olefins: the references state that no reaction product was obtained when ethylene is used as the feed.

OLIGOMER PRODUCTS

The present oligomers of 1-olefins usually have much lower molecular weights than the polymers produced in cited reference which are semi-solids, with very high molecular weights and are not suitable as lubricant basestocks. These high polymers usually have no detectable amount of dimer or trimer components from synthesis and unsaturations, attributable to the lower proportion of unsaturated terminal groups on the high molecular weight product. The products of the present invention, however, are free-flowing liquids at room temperature, suitable for use as lube basestocks and additives e.g. VI improvers.

Lube compositions from the oligomerization of $C_2$–$C_5$ alpha-olefin mixtures or $C_3$–$C_5$ alpha-olefins can be produced with viscosities between 3 cS and 5000 cS measured at 100° C. Generally, higher reaction temperatures are conducive to the production of lube products of lower viscosity and lower molecular weight. For example, at 185° C. (Example (A), the product from the typical $Cr/SiO_2$ catalyst had a viscosity of 51.69 cS and a molecular weight of 1432. This type of product, with a viscosity of 3–300 cS, is especially suitable as a blending stock with other lubricants. At lower reaction temperatures, higher viscosity and higher molecular weight products are formed. For example, at 95° C. (Example 11), the oligomer produced had a molecular weight of 4,880. This higher molecular weight material is especially suitable for use as a VI improver. In general, higher reaction temperature produce products with higher contents of irregular connections such as head-to-head or tail-to-tail connections. The higher level of regio-irregularity may contribute partly, as there, to the thermal stability of the product.

For ethylene and alpha-olefin copolymerization, the amounts of ethylene in the feed (or ethylene to $\alpha$-olefin ratios) also affect the product viscosity. Higher ethylene content generally yields higher product viscosity (or molecular weight) if other reaction variables are kept constant.

Other reaction variables such as the addition of chain regularity agents, hydrogen and the like, the use of large amounts of solvent to create high dilution, may also affect the molecular weight of the product.

The molecular weights of the oligomers useful as lubricant basestocks and VI improvers fall within the range of 250 to about 100,000, with a preferred range of about 300 to about 30,000. Too high a molecular weight in the product leads to shear instability whereas at too low a molecular weight, the product will have an undesirably high volatility. The molecular weight should therefore be adjusted according to the application of the product.

The products usually have a molecular weight distribution of about 1.1 to about 5, with a narrow molecular weight distribution of from about 1.1 to about 3 preferred.

Table 1 below reports the results of the spectroscopic determination of the regio-regularity of the present oligomer products (Nos. 3–5) as well as the results from the products of 1-decene and 1-hexene oligomerization. The C-13 NMR spectra and the INEPT (Insensitive Nuclei Enhancement by Polarization Transfer) spectra of four products prepared from $Cr/SiO_2$ catalyzed HVI-PAO oligomerization process reactions of 1-decene, 1-hexene, 1-butene and propene are presented. For each oligomer, the chemical shifts of the methylene and methine carbons of the backbone are calculated and assigned based on different combinations of regio-irregularity. From the 2/4J INEPT spectrum which selectively detects only the methine carbons, the amount of regio-regularity of each oligomer is estimated. Entries 1–4 compare four different alpha-olefins as the starting material. The results indicate that the oligomers from the higher olefins are formed in a more regio-regular fashion than the lower olefins.

TABLE 1

| No. | Olefin | Viscosity, cS, 100° C. | Regio-Regularity |
|---|---|---|---|
| 1 | 1-decene | 145.0 | >58 |
| 2 | 1-hexene | 92.8 | ~51 |
| 3 | 1-butene | 103.7 | ~48 |
| 4 | propene | 95.3 | ~41 |
| 5 | 1-butene | 2.8 | ~38 |

EXAMPLE 1

Catalyst Preparation and Activation Procedure 1.9 grams of chromium (II) acetate ($Cr_2(OCOCH_3)_42H_2O$) (5.58 mmole) (commercially obtained) was dissolved in 50 cc of hot acetic acid. Then 50 grams of a silica gel of 8–12 mesh size, a surface area of 300 $m^2/g$, and a pore volume of 1 cc/g, was added. Most of the solution was absorbed by the silica gel. The final mixture was mixed for half an hour on a ROTO-VAP (T. M.) at room temperature and dried in an open-dish at room temperature. First, the dry solid (20 g) was purged with N at 250° C. in a tube furnace. The furnace temperature was then raised to 400° C for 2 hours. The temperature was then set at 600° C. with dry air purging for 16 hours. At this time the catalyst was cooled down under $N_2$ to a temperature of 300° C. Then a stream of pure CO (99.99% from Matheson) was introduced for one hour. Finally, the catalyst was cooled down to room temperature under $N_2$ and ready for use.

EXAMPLE 2

A $Cr/SiO_2$ catalyst was prepared as described in Example ]and 3 g. of the activated $Cr/SiO_2$ catalyst was packed in a fixed bed down flow reactor of ⅜" id. Propylene of 5 gram per hour was reacted over the catalyst bed heated to 180°–190° C. and at 220 psig. After 16 hours, 56.2 gram of liquid product and 24.9 gram of gas were collected. The gas product analyzed by gc contained 95% propylene. The liquid product had the following compositions:

| | $C_6$ | $C_9$ | $C_{12}$ | $C_{15}$ | $C_{18}$ | $C_{21}$ | $C_{24}$ | $C_{27}$ | $C_{30}$+ |
|---|---|---|---|---|---|---|---|---|---|
| Wt. pct. | 10.6 | 11.2 | 8.6 | 7.4 | 3.3 | 3.9 | 2.9 | 3.9 | 48.3 |

The products from $C_6$ to $C_{12}$, after hydrogenation, can be used as gasoline components. The products from $C_{12}$ to $C_{24}$ can be used as distillate components. The unhydrogenated lube product, most $C_{27}$ and higher hydrocarbons and isolated after distillation at 180° C./0.1 mm Hg, have viscosity at 100° C. of 28.53 cS and VI of 78. The unhydrogenated lube product had higher VI than the same viscosity oil produced from propylene by $AlCl_3$ or $BF_3$ catalyst, as summarized below.

| Catalyst | Unhydrogenated lube yield | V @ 100 C., cS | VI |
|---|---|---|---|
| $AlCl_3/HCl$ | 87 | 29.96 | 38 |
| $BF_3H_2O$ | 23 | 7.07 | 46 |

The unhydrogenated oligomer product from $Cr/SiO_2$ catalyst has a simpler C13-NMR spectrum than the product from acid catalysts.

EXAMPLE 3

The procedure of Example 2 was followed, except that the reaction was run at 170° C. and 300–400 psig. After 14 hours reaction, 47.5 grams liquid and 18.4 g gas (mostly propylene) were collected. The liquid product had the following composition, analyzed by gc:

| | $C_6$ | $C_9$ | $C_{12}$ | $C_{15}$ to $C_{20}$ | $C_{20}$ to $C_{30}$ | $C_{30}$+ |
|---|---|---|---|---|---|---|
| Wt. pct. | 4.51 | 5.53 | 5.01 | 12.22 | 5.30 | 67.43 |

The unhydrogenated lube fraction after distillation to remove light end at 160° C./0.1 mm Hg, had viscosity at 100° C. of 39.85 and VI of 81.

EXAMPLE 4

A $Cr/SiO_2$ catalyst was prepared as in Example 1. To a tubular reactor packed with three grams of 1% Cr on silica catalyst, propylene of 5 g/hr and ethylene 1.13 g/hr (molar ratio of $C_3/C_2=3$) were fed through at 190° C. and 200–300psig. The liquid product weighed 68 grams, after 15 hours on stream. This once-through liquid yield was 75%. The gas contained ethylene and propylene which can be recycled. The liquid product was centrifuged to remove the small amount of solid particles. The clear liquid was fractionated to give 50% light fraction boiling below 145° C. at 0.01 mmHg and 50% unhydrogenated lube product. The unhydrogenated lube product had Viscosity at 100° C.=46.03 cS, Viscosity at 40° C.=703.25 cS and VI=112. The light fractions were unsaturated olefinic hydrocarbons with six to 25 carbons. The ir showed the presence of internal and vinylidene double bonds. These olefins can be used as starting material for synthesis of other value-added products, such as detergents, additives for lube or fuel. These light fractions can also be used as gasoline or distillates.

EXAMPLE 5

The run in Example 2 was continued for another 23 hours and 78 grams liquid product was collected. The once-through liquid yield was 54%. This liquid product was centrifuged to remove the solid precipitate. The clear product was fractionated to give 35% light liquid boiling below 145° C. at 0.1 mm Hg and 65% viscous unhydrogenated lube product. The unhydrogenated lube product had V@100=72.40 cS, V@40=980.73 cS and VI=144.

EXAMPLE 6

The reactor, propylene and ethylene feed rates were the same as in Example 4. In addition, n-octane was fed through the reactor at 10 cc/hr as solvent at 185° C. After 17 hours on stream, 228 grams of liquid product was collected. Material balance indicated that all ethylene and propylene was converted into liquid product. The liquid, after filtering off trace solid, was fractionated to give four fractions:

Fraction 1, boiling below 130° C., 118 g, mostly n-octane solvent;

Fraction 2, up to 123° C./0.01 mmHg, 32 g.;

Fraction 3, up to 170° C./0.01 mmHg, 27 g; and

Fraction 4, residual product, 40 g.

Fraction 4 had the following viscometric properties: V@100=30.99 cS, V@40=343.44 cS, VI=126.

This Example demonstrates that the presence of an inert solvent is advantageous to produce lower viscosity lube. The presence of an inert solvent also prevents the reactor from plugging by trace solid formation.

EXAMPLE 7

This Example illustrates the preparation of polypropylene liquid product using both a reduced metal catalyst (Ex. 7) and a Ziegler catalyst (Ex. 7B).

EXAMPLE 7A

An activated chromium on silica catalyst (15 grams) and purified n-decane (400 cc) were charged into an one-liter autoclave with stirring under nitrogen atmosphere. When the autoclave temperature reached 160° C., liquid propylene was fed at 50 cc/hr until 375 cc was charged into the reactor. After 16 hours at 160° C., the slurry product was discharged, filtered to remove solid catalyst and distilled up to 120° C. at 0.1 mmHg vacuum to remove light ends. The product yields and properties are summarized in Table 2.

EXAMPLE 7

Preparation of polypropylene liquid product by Ziegler catalyst, ZrCp2Cl2/MAO.

A solution catalyst containing 0.17 mmole zirconocene dichloride and 88 mmole methylaluminoxane in 150 cc toluene was add to an one-liter autoclave at 25° C. Propylene was then added at 50 cc/hr until 375 cc was charged into the reactor. After 16 hours, the catalyst components were deactivated by adding 1 cc water. The liquid product was isolated by drying and filtration to remove solid components. The lube product was isolated as in Example 7A. The product yields and properties are summarized in Table 2 below.

The polymer structures produced by the use of the chromium catalyst are uniquely irregular. The $C_{13}$ NMR spectra of these two examples indicated that the chromium product of Example 7A is much less regular than the Ziegler product of Example 7B. The amount of this regio-irregularity can be determined by the C-13 2/4J INEPT (Insensitive Nuclei Enhancement by Polarization Transfer) NMR technique. The INEPT spectra of the products of Examples 7A and 7B showed the different types of the methine carbons in the backbones of chromium product and the Ziegler product.

The data in Table 2 show that the chromium product had better thermal stability than the regular Ziegler product, when cracked at 280° C. under nitrogen atmosphere for 24 hours.

EXAMPLE 8

Preparation of poly-1-butene liquid products, using a reduced metal catalyst (Ex. 8A) and a Ziegler catalyst (Ex. 8B).

EXAMPLE 8A

Poly-1-butene was produced in a continuous, downflow fixed bed reactor. The reactor was constructed of ⅜" o.d. stainless steel tube. The bottom of the reactor contained 18 grams of clean 14/20 mesh quartz chips, supported on a coarse frit of 6 mm diameter. Three gram activated chromium catalyst was charged into the tube. The top of the reactor tube was packed with quartz chips to serve as a feed preheater. The reactor tube was wrapped with a heat-conducting jacket. The reactor temperature, 125° C., was measured and controlled with a thermocouple located at the middle of the jacket. 1-Butene liquid was pumped through a 50 cc Hoke bomb packed with Deox and 13X molecular sieve of equal volume to remove oxygenates and water contaminants. 1-Butene was fed into the reactor from the top. Reactor pressure, 320 psig, was controlled by a grove-loader at the reactor outlet. The effluent was collected at the reactor bottom and the lube product was isolated by distillation up to 140+ C. at 0.1 mmHg vacuum. The product properties are summarized in Table 2.

EXAMPLE 8B

Preparation of poly-1-butene liquid product by Ziegler catalyst, ZrCp2Cl2/MAO

The product was prepared as in Example 7B, except 1-butene was used as feed. The product yield and properties are summarized in Table 2.

The C13 NMR spectra of the two products of Examples 8A and 8B show that the chromium product of Example 8A is much less regular than the Ziegler product of Example 8B as well, by comparison with spectra reported in the literature for Ziegler polymers. The data in Table 2 show that the chromium product of Example 8A had better thermal stability than the regular Ziegler product of Example 8B, when cracked at 280° C. under nitrogen atmosphere for 24 hours.

EXAMPLE 9

Preparation of ethylene/propylene copolymer, using a reduced metal catalyst and a Ziegler catalyst.

EXAMPLE 9A

As Example 7A, except gaseous ethylene (25.2 g/hr) and propylene (25 g/hr) were fed simultaneously into the autoclave at 185° C. The product yield and properties are summarized in Table 2.

EXAMPLE 9B

Preparation of ethylene/propylene copolymer liquid product by Ziegler catalyst, ZrCp2Cl2/MAO As Example 7B, except ethylene (25.2 g/hr) and propylene (25 g/hr) were fed simultaneously into the autoclave at 60° C.

The product yield and properties are summarized in Table 2. The C13 NMR spectra of the products indicated that the chromium product of Example 9A is much less regular than the Ziegler product of Example 9B.

TABLE 2

| | Product Yields and Properties | | | | | |
|---|---|---|---|---|---|---|
| | Example No. | | | | | |
| | 7A | 7B | 8A | 8B | 9A | 9B |
| Feed | $C_3$= | $C_3$= | 1-$C_4$= | 1-$C_4$= | $C_2$=/$C_3$= | $C_2$=/$C_3$= |
| Catalyst | Cr/$SiO_2$ | Zr/MAO | Cr/$SiO_2$ | Zr/MAO | Cr/$SiO_2$ | Zr/MAO |

TABLE 2-continued

| Product Yields and Properties | Example No. | | | | | | |
|---|---|---|---|---|---|---|---|
| | 7A | 7B | | 8A | 8B | 9A | 9B |
| Yield, wt % | 55 | 48 | 79 | 86 | 75 | 85 | >80 |
| Properties | | | | | | | |
| V @ 100° C., cS | 95.27 | 62.37 | 157.2 | 115.15 | 192.62 | 51.69 | 61.09 |
| VI | 82 | 59 | 105 | 91 | 123 | 154 | 173 |
| Thermal Stab. % Viscosity Loss at 280° C. | 31 | — | 69 | 41 | 67 | — | — |
| $MW_n$* | | | | | 1295 | 1432 | 581 |
| $MW_w$* | | | | | 3070 | 3632 | 3664 |
| MWD | | | | | 2.37 | 2.54 | 2.32 |

Note:
*Molecular weights of these samples were obtained by GPC calibrated to polystyrene standards.

EXAMPLE 10

A polypropylene liquid product was prepared using a reduced metal catalyst, in a similar manner to Example 7A, except the autoclave was heated to 80° C. The product yield and properties are summarized in Table 3 below.

EXAMPLE 11

An ethylene/propylene copolymer liquid was prepared as described in Example 10, except ethylene (16.7 g/hr) and propylene (25g/hr) were fed simultaneously into the autoclave at 95° C. The product yield and properties are summarized in Table 3.

TABLE 3

| Product Yields and Properties of Example 10 and 11 | Example 10 | Example 11 |
|---|---|---|
| Catalyst | $Cr/SiO_2$ | $Cr/SiO_2$ |
| Feed | C3= | C2=/C3= |
| Yield | — | — |
| Product properties | | |
| MWn | 3900 | 4880 |
| MWD | 2.74 | 2.85 |

The estimated amounts of regio-irregularity of these products together with the reported data from the products obtained by Ziegler catalysts are summarized in Table 4.

TABLE 4

| Product Regio-Irregularity | | | |
|---|---|---|---|
| Sample | Catalyst | MWn | Mole % of irregular propylene |
| Example 7A | $Cr(II)/SiO_2$ | 1532 | 37 |
| Example 10 | $Cr(II)/SiO_2$ | 3900 | 21 |
| Reference* | $V(mmh)_3/AlEt_2Al$ | 3900 | 14 |
| Reference* | $TiCl_4/MgCl_2/AlEt_2Al$ | — | 4 |
| Reference* | $Ti(OBu)_4/MgCl_2/AlEt_2Al$ | 8 | |
| Example 7B | $ZrCp_2Cl_2/MAO$ | 400 | <5 |

*Y. Doi et al., "C13-NMR Chemical Shift of Regio-Irregular Polypropylene" Macromolecules 20 616–620 (1987).

As these results show, the polypropylenes by chromium catalyst have much higher amounts of regio-irregularity than products by other catalysts. These unique structure features are responsible for its better thermal stability as shown above.

The $C_3$–$C_5$ homo-polymer or co-polymer with ethylene can be used as blending components with mineral oil or low viscosity synthetic lubricants to improve viscosities and VIs. The blending results with mineral oil or synthetic oil are summarized in Table 5 below. As these blending examples show, products from Example 10 and 11 improve the oil viscosity and VI. The products of Examples 10 and 11 have low molecular weights, in the range of thousands and may therefore be expected to have much better shear stabilities than comparable polymers of higher molecular weight.

TABLE 5

| Blending Results with oils | | | |
|---|---|---|---|
| Blending Stock | V, 100° C., cS | V, 40° C., cS | VI |
| Mineral Oil | 4.19 | 21.32 | 97 |
| 10% Ex. 10 product | 9.44 | 60.19 | 138 |
| 10% Ex. 11 product | 19.48 | 128.74 | 173 |
| Synthetic oil | 5.61 | 28.94 | 136 |
| 10% Ex. 10 product | 10.70 | 67.09 | 149 |
| 10% Ex. 10 product | 16.93 | 108.34 | 170 |
| 5% Ex. 11 product | 8.09 | 46.36 | 148 |
| 5% Ex. 11 product | 10.50 | 58.56 | 170 |

We claim:

1. A liquid composition comprising the product of the oligomerization of a $C_3$ to $C_5$ alpha-olefin, mixtures of $C_3$ to $C_5$ 1-olefins or mixtures of $C_3$ to $C_5$ 1-olefins with ethylene, under oligomerization conditions in contact with an oligmerization catalyst comprising a reduced valence state Group VIB metal catalyst on a porous support, the product having a regio-irregularity of at least 20 percent.

2. A liquid composition according to claim 1 in which the regio-irregularity is from 20 to 60 percent.

3. A liquid composition according to claim 2 in which the regio-irregularity is from 20 to 40 percent.

4. A liquid composition according to claim 1 in which the 1-olefin comprises 1-propylene.

5. A liquid composition according to claim 1 in which the 1-olefin comprises 1-butene.

6. A liquid composition according to claim 1 in which the 1-olefin comprises 1-pentene.

7. A liquid composition according to claim 1 in which the liquid is the product of oligomerization of at least one $C_3$ to $C_5$ 1-olefin with ethylene.

8. A liquid composition according to claim 7 in which the 1-olefin comprises 1-propylene and the molar ratio of propylene to ethylene is from 100:1 to 0.1:1.

9. A liquid composition according to claim 8 in which the 1-olefin comprises 1-propylene and the molar ratio of propylene to ethylene is from 10:1 to 1:1.

10. A liquid composition according to claim 1 in which the liquid is the product of oligomerization of at least one $C_3$ to $C_5$ 1-olefin produced at an oligomerization temperature from 90° to 250° C.

11. A liquid composition according to claim 1 in which the liquid has a molecular weight within the range of about 250 to about 100,000.

12. A liquid composition according to claim 1 in which the liquid has a molecular weight within the range of about 300 to about 30,000.

13. A liquid composition according to claim 1 in which the liquid has a molecular weight distribution of about 1.1 to about 5.

14. A liquid composition according to claim 13 in which the liquid has a molecular weight distribution of about 1.1 to about 3.

15. A liquid composition according to claim 1 in which the liquid is the product of oligomerization of at least one $C_3$ to $C_5$ 1-olefin with ethylene produced at an oligomerization temperature from 0° to 250° C.

16. A liquid composition according to claim 1 which has a viscosity between 3 cS and 5000 cS, measured at 100° C.

17. A liquid composition according to claim 1 which has been hydrogenated after formation of the olefin oligomer.

18. A liquid composition according to claim 1 in which the liquid oligomer product comprises at least 40 wt. percent $C_{30}+$ lubricant range oligomers.

19. A liquid composition according to claim 1 in which the catalyst comprises reduced chromium metal oxide on a porous support.

20. A liquid composition according to claim 19 in which the support comprises silica.

* * * * *